United States Patent [19]

Zöllner et al.

[11] Patent Number: 4,481,500

[45] Date of Patent: Nov. 6, 1984

[54] ELECTRODE FOR ELECTRIC ARC FURNACES

[75] Inventors: Dieter Zöllner, Schwaig; Claudio Conradty, Röthenbach; Friedrich Rittmann, Rückersdorf, all of Fed. Rep. of Germany

[73] Assignee: Arc Technologies Systems Ltd., Cayman Islands

[21] Appl. No.: 326,068

[22] Filed: Nov. 30, 1981

[30] Foreign Application Priority Data

Dec. 2, 1980 [EP] European Pat. Off. ..... 80107523.5

[51] Int. Cl.[3] ..... H05B 7/08

[52] U.S. Cl. ..... 373/93; 373/92

[58] Field of Search ..... 373/93, 94, 92, 91

[56] References Cited

U.S. PATENT DOCUMENTS

| | | | |
|---|---|---|---|
| 824,153 | 6/1906 | Seward | 373/93 |
| 3,046,319 | 7/1962 | Daley | 373/94 |
| 3,293,347 | 12/1966 | Wooding | 373/94 |
| 3,526,699 | 9/1970 | Usherwood | 373/94 |

*Primary Examiner*—Roy N. Envall, Jr.
*Attorney, Agent, or Firm*—John J. Freer

[57] ABSTRACT

The invention concerns an electrode for arc furnaces, especially for electrosteel production, comprising a metallic liquid-cooled upper shaft (1) and an exchangeable lower active portion (2) of self-consuming material, particularly graphite, whereby a securing means is provided which is electrically insulated against the current-conducting components (11) of the shaft (1) and said securing means detachably connects the shaft (1) with the active portion (2) as well as holding the contact surfaces of the active portion (23) pressed against the contact surfaces (14) of the current-conducting components (11) of said shaft.

To further develop an electrode of this type, which also provides the possibility of rapid and simple disconnection or connection with respect to the shaft (1) and the active portion (2) with a simple design, especially of the area of the active portion on the connection side, the securing device is designed as a clamping means (40; 60) which takes direct effect on the upper end of the active portion (2) in such manner that the clamping force essentially pressure-loads the material of the active portion (2), whereby the physical properties of the material of the active portion (2) are so exploited that no complicated designs are required on the connection side for said active portion (2).

45 Claims, 12 Drawing Figures

ELECTRODE FOR ELECTRIC ARC FURNACES

FIELD OF THE INVENTION

The invention concerns an electrode for arc furnaces, especially for the production of electrosteel, comprising a metallic liquid-cooled upper shaft and a replaceable lower active portion of self-consuming material, especially of graphite, whereby a securing device is provided which is electrically insulated against the electrical current-conducting components of said shaft, and this device detachably connects the shaft and the active portion and also holds the contact surfaces of said active portion pressed against the contact surfaces of the current-conducting components of said shaft.

BACKGROUND OF THE INVENTION

Electrodes for arc furnaces are subjected to strong thermal and mechanical loads. The strong thermal loads result from the high working temperatures used in such arc furnaces, especially during the manufacture of electrosteel. Great mechanical loads arise during the running-in of electrodes due to contact with scrap and to the scrap parts falling into the smelt(so-called scrap dislocation). In addition the electrodes are caused to oscillate by electromagnetism, and the oscillations can attain substantial frequencies and amplitudes. Thus great acceleration forces arise which effect the electrodes as flexing or torsional loads. Moreover the generally rough and dust-laden operations during steel manufacture are an additional factor. Because of these conditions the connection of the shaft with the active portion of such electrodes raises considerable difficulties. Even so it is important that the connection between the shaft and the active portion should be simple in design, easy to detach and should cause only minor electrical inefficiencies or losses.

In the past screw connections between the shaft and the active portion were primarily favored (cf.e.g. DE-AS No. 27 39 483, out of the voluminous prior art). With this type of connection the shaft has a sleeve or the like at its lower end, which possesses an internal thread. At the upper end of the active portion there is a blind end bore which also has an internal thread. A screw-nipple is screwed into these two inner threads, which preferably consists of the same material as the active portion, i.e. primarily of graphite.

Special threads have been developed for such screw connections. These threads are not only adapted to the material of the active portion or of the screw nipple, but are also intended to take account to a large extent the operating conditions described above. The thread must for this purpose be as far as possible self-locking. It must also form good electrical contact surfaces, since at least sometimes a not insubstantial part of the electrical current flows via the screw nipple. In addition, tables have been compiled which show what torque must be applied in individual cases to the screw nipples in order to bring the contact surfaces between the shaft and the active portion into the desired pressure position which ensures an adequate electrical contact between said contact surfaces.

Certainly the screw solution has proven itself in use per se. But for many applications the changing of the active parts is a lengthy and costly process. In this connection designs would be desirable which make possible, while providing adequate thermal and mechanical strength, more rapid detachment of the active portion after its consumption from the relevant shaft and/or a faster and simpler mounting of an unused active portion on the shaft. Moreover the increasing cost of the active portions due to the rise in raw materials and energy costs compels the user to make the fullest use of the material in the active portion.

An electrode of the type prescribed in the preamble of patent claim 1 is already known(DE-OS No. 28 11 877) which allows in principle the simple detachment of a used active portion from the upper shaft and the mounting of an unused active portion on the shaft again. This known design is characterized in that the current transfer between the metal shaft and the active part and the detachable connection between the shaft and the active portion are functionally separated. However the securing device of the known electrode presupposes a special design of the upper end of the active portion. The upper end of the active portion is in fact equipped with a specially designed connector piece which consists of a round plate, on the under side of which an axial collar corresponding to the plate diameter is located, while on the upper side there is an extension of lesser diameter, which has a radially projecting flange. In a central borehole of the connector piece, a tension screw is provided to brace the connector piece with the active portion. For this purpose the upper part of the active portion is so designed that it embraces the head of the tension screw and engages in the collar which is conically shaped at the point of contact. Thereby the fracture of the upper end of the active portion under the influence of transverse forces and of the tension screw is prevented. On the side of the shaft, the securing device comprises a cage in the form of a hollow cylinder, which is equipped at its bottom end on the periphery with a plurality of recesses, into which clamping bodies are inserted. These bodies are radially movable and have the form of balls or rollers. The cage is linked by a piston to a hydraulic cylinder, and this piston can move the cage and with it the clamping bodies in relation to the cylinder in the axial direction. The clamping bodies then interact with an inclined control edge so that the clamping bodies, when raised by the hydraulic cylinder, are moved radially inward by said control edge, whereby they are positioned under an edge of an extension of the connector piece. This causes a positive locking of the active portion with the shaft.

The securing device of the known electrode just described is extremely complicated. This results primarily from the need to equip the active portion with a specially designed connector piece which has to be braced by a tension screw to the upper end of the active portion. This design is necessary because in view of the arrangement chosen, the material of the active portion is tension loaded. The tensile strength of the relevant materials for the active portions, especially of graphite, is however substantially less than the compression strength of the materials concerned. The arrangement chosen for the known solution using a connector piece and a tension screw for the active portion obviously makes the electrode more costly.

A further disadvantage of this system is the necessity to use metallic parts as securing elements which are not cooled in the hot active portion of the electrode.

In a substantially similar known electrode, instead of the ball mechanism just described, a tongs mechanism is used (U.S. Pat. No. 3,311,693, FIG. 2). In this design as well, the top end of the active part has to be equipped with a specially designed connector piece, so that the same disadvantages apply to this arrangement as in the case of the electrode design already described.

DISCLOSURE OF THE INVENTION

Against this it is the object of the invention to further develop an electrode of the type above in such manner that when providing the possibility for rapid and simple disconnection or connection with respect to the shaft and the active portion, a simple design results especially as regards the connection side area of the active portion. Here the definition of the object is based on the consideration that the physical properties of the material of the active portion should be exploited so that no complicated design is necessary on the connector side of the active portion.

This object is attained in an electrode of the type specified by the invention in that the securing device is designed as a clamping means which directly affects the upper end of the active portion in such a way that the clamping force substantially pressure-loads the material of the active portion.

The invention proceeds from the fact that the compression strength of the materials conventionally used for the active portions is substantially greater than the bending strength and the tensional strength. For example in the case of graphite, the compression strength is about 3 to 3.5 times greater than the tensile strength and/or the bending strength. Since the clamping means of the invention engage the upper end of the active portion so that the clamping force essentially pressure-loads the material of said active portion, the invention makes use of the high compression strength of the relevant materials for these active portions. An adequate clamping force can be transferred to the active portion without the necessity as in the prior art, for connecting a separate connector piece with the upper end of the active portion, so that the clamping force of the clamping means is transferred to said connector piece. Due to the utilization of the high compression strength of the relevant materials for the active portion, despite the direct application of the clamping force to the active portion, these materials can be correspondingly highly selected to resist the high mechanical loads to which the electrodes are subjected and reliably retain the active portion in the shaft.

Since in the solution of the invention, the clamping means take effect directly on the upper section of the active portion, this upper section can have a relatively simple form which is therefore relatively inexpensive to manufacture. Hence when making the active portions, the upper section thereof can be given this shape in one working phase. In certain embodiments of the clamping means, the now customary shape of the electrodes made wholly of graphite can be maintained. The separate assembly, required with the known designs of electrode, for the connector piece using tension screws or the like becomes superfluous. Thus the electrodes of the invention are substantially cheaper to produce than the known designs.

Moreover the clamping means of the invention permit, especially when compared with the known designs using screw nipples, the simple and rapid detachment of a used active portion from its shaft. The same applies to the mounting of an unused active portion on the shaft. Thus by the use of the electrodes of the invention, the work can be done more rationally with essential savings in the setting- times.

Since, when using the electrodes of the invention, it is not necessary to equip the connector section of the active portions with special devices, it is possible to consume the connector section of the active portion without difficulty. This produces a substantial saving in materials or a high degree of material usage by comparison with the known solutions.

The design of the invention also permits the use of cheaper materials for the active portions of high-performance electrodes than can be employed at present for such high-power electrodes. For example graphite with the following physical properties is used for high-power electrodes:

| | |
|---|---|
| Bending strength | 120 to 140 daN/cm$^2$ |
| Tensile strength | 100 to 120 daN/cm$^2$ |
| Compression strength | about 350 daN/cm$^2$ |
| specific electrical resistance | 6.5 to 7.5 $\frac{\Omega}{mm^2/m}$ |

This refers to secondary compression electrodes. These can be loaded for example in the case of a diameter of about 500 mm from about 50,000 to 55,000 A.

Employing the invention it is possible to load electrodes with a diameter of about 400 mm to about 50,000 to 55,000 A when employing graphite of the following physical properties:

| | |
|---|---|
| bending strength | 80 to 100 daN/cm$^2$ |
| tensile strength | about 80 daN/cm$^2$ |
| compression strength | about 300 daN/cm$^2$ |
| specific electrical resistance | 7.5 to 8.5 $\frac{\Omega}{mm/m}$ |

This refers to non-compressed graphite electrodes.

Because, using the electrodes of the invention, it is not necessary, in contrast to the prior art, to fit the top end of the active portion with a special connector piece, the current can be fed directly from conductive components of the shaft into the active portion. It is only necessary to bring a contact surfaces of the current-carrying components of the electrode shaft into abutment with the top front edge of the active portion. But in the known designs it was necessary in many cases to design special contact surfaces on the connector pieces of the active portions (cf. e.g. U.S. Pat. No. 3,311,693), which made these arrangements even more costly. The solution of the invention therefore makes it possible in a much-simplified manner to separate functionally the current supply between the current-conducting components of the shaft and the active portion and the clamping means for the mechanical connection of the two parts of the electrode. The result is that especially simple and materialssaving design opportunities arise both for the electrical connection as well as for the mechanical connection between shaft and the active portion.

Expedient embodiments of the solution of the invention can be found in the other patent claims.

Accordingly due to the separation of the mechanical and electrical connection between the shaft on the one hand and the active portion on the other, and due to the direct engagement of the clamping means on the material of the active portion because of its compression loading, caused by the clamping force, an especially great abundance of design possibilities results.

Thus it is possible to actuate the clamping means not only mechanically, pneumatically or by hydraulic systems. On the contrary there is also the opportunity to create the clamping force at least substantially from the weight of the active portion itself.

Further the clamping means can have a separate cooling system or it can be linked with the cooling device for the shaft.

Moreover the clamping means can grasp the active portion in its upper area, externally and/or internally. The only requirement is that the clamping force substantially pressure-loads the material of the active portion.

Since, according to the invention, the clamping means take effect directly on the active portion, it is only necessary to adjust the active portion, depending on the type of clamp, by forming matching parts, apertures, recesses and grooves. The respective form of the connector area of the active portion can be produced during the manufacture of the active portion itself. In an especially advantageous solution, the active portion can be inserted in unchanged form and/or without any further processing after the basic production process.

A concrete embodiment of the solution of the invention is characterized in that the clamping means have at least two jaws, which are movable by a relative motion radially to at least one inclined surface and jointly axially, and in the active portion a blind hole is provided having an undercut clamping surface with which the clamping surfaces of the jaws can be made to abut.

This clamping device is distinguished by its high mechanical and also high thermal resistance to loads, accompanied by simple design. It works reliably at all times with simple means.

An especially simple embodiment of the design in question results from forming the inclined surface directly between two clamping jaws which are movable in relation to each other.(FIG. 1 and 2).

Here it is expedient that the clamping jaws should be positively guided on the inclined surface, e.g by means of a swallow-tail guide.

But the clamping device can also be advantageously designed as a collet. Here there are two possibilities. Either the clamping force is applied via the outer surface of the collet to the active portion. Or this can be achieved by the inner surface of the collet.

For the design of the collet there are also several advantageous variants. The collet can either be designed as one piece and equipped with at least one longitudinal slit or it can be composed of a number of segments.

A further concrete embodiment of the electrode of the invention consists of one in which the clamping means grasps the active portion at its surface, the current-carrying component of the metal part is arranged within the collet of the clamping means, and the collet is surrounded by a tube, on the inside of which wedge surfaces are arranged which interact with the wedge surfaces on said collet (FIG. 3). This embodiment has mainly the advantage that the tube surrounding the collet is intended not only to control said collet, but moreover to protect the whole device effectively against thermal and mechanical attacks, since this outer tube can easily be designed so that the tube is given an adequate wall thickness and the outside thereof is correspondingly coated. Here there is also the possibility that via this tube the cooling medium for the individual components can be supplied to the parts of the shaft to cool the tube and these components as well. This provides an especially compact design of this embodiment of the inventive electrode.

Lastly this design also has substantial advantages with respect to the form of the active portion. Since the collet directly engages the surface of the active portion, the latter does not require any special design for connection with the collet. It may only be necessary to increase safety to provide the surface of the active portion with a peripheral groove in which the clamping means are fitted in order to raise the transferable load. It is particularly advantageous when the active portion on the connection side has a flat front surface. This makes it possible to equip the connection side of the active portion with an internally threaded blind hole for screw nipples. In this way the upper section of such an active portion can easily be supplied for consumption, in that this section is attached to the lower end of an active portion to be inserted by the use of a screw nipple.

A further embodiment of the inventive electrode is characterized in that the clamping means is located within the current conducting component of the shaft and the collet grasps the active portion at a clamping lug provided thereon (FIGS. 5,6,7 and 9,10). This embodiment is distinguished by the fact that the diameter of the shaft can be kept relatively small, so that the outer diameter of the shaft can substantially correspond to the outer diameter of the active portion which is of major practical significance.

The embodiment described above permits an abundance of possibilities for the actuation of the clamping means. In a first variant the pressure arrangement comprises a pressure sleeve, the conical inner surface of which abuts the corresponding conical outer surface of the collet. A second embodiment shows that the pressure arrangement comprises a mushroom- shaped pull rod, the conical outer surface of which abuts a corresponding conical inner surface of the collet.

The directly adjoining connector parts of the clamping means on the one hand and of the active portion on the other can be designed either cylindrically or conically. Using the cone form, apart from the pressure locking effect there is also a partial positive fixing of the components.

If especially large loads have to be transferred between the shaft and the active portion, it is advisable to produce, apart from the pressure locking, means which increase the safety degree by a positive locking effect between the parts to be linked. This can be done by arranging that the effective outer or inner surface of the collet have additional projections which engage in corresponding recesses on the active portion. It is especially advantageous if the projections to form a locking coupling are resiliently radially mounted when the active portion is thrust onto the collet, which can be achieved by the allocation of springs to the movable projections.

As already stated above, the clamping means can be controlled either hydraulically or pneumatically.

In a first embodiment the pressure arrangement of the collet has wedges which are axially movable by hydraulic or pneumatic means. These wedges combine both pressure and positive locking. In another variant, the pressure arrangement of the collet has radially movable rams moved by hydraulic or pneumatic methods which take effect on the collet correspondingly to produce the clamping force.

In an embodiment of the inventive electrode in which the clamping means surround the current-conducting component of the shaft, it is especially advantageous that the current-conducting component can be designed as a plain rod, which ends at its lower end as a contact plate. Thus the current-conducting component can be produced with major material savings. The outer side of the plain rod can be surrounded by cheaper material which may be provided with a cooling system, in order to protect the current-conductive solid bar aqainst loads of thermal or mechanical type. The contact plate provides a large contact surface between the current-conducting component of the shaft and active portion, with the result that there is an effective transfer of current at this contact surface.

It is advisable that the outer diameter of the contact plate should approximately correspond to the outer diameter of said active portion.

According to the other basic design variant described above, in which the current-conducting component of the shaft is formed as a tube and the clamping means are arranged therein, it is advantageous that the outer diameter of the tube should approximately correspond to the outer diameter of the active portion.

The design of the tube can be optimized in every way with respect to the mechanical and electrical needs of the total arrangement.

Finally it is conceivable that the clamping means should only be designed to be axially movable, and to connect the connector part of the clamping means positively with the connector part of the active portion. A concrete embodiment consists of providing that the upper end of the active portion has a transverse groove perpendicular to the axis, open to the front surface and equipped with an undercut, in which, perpendicularly to the axis, a corresponding connector part of the clamping means is then inserted. The connector part of the clamping means has then only to be moved axially in order to bring the front contact surfaces of the connector part into pressure abutment with the contact surfaces of the current-conducting component of the shaft, in order to cause the requisite electrical contact between the two components. The geometric design of the clamping zones should be so arranged that the mechanical loading of the active portion appears primarily in the form of pressure-loads.

Further details and advantages of the invention emerge from the specification of the embodiments shown in the drawings.

BEST EMBODIMENT OF THE INVENTION

Since the basic design of the relevant electrodes consisting of a metallic liquid-cooled upper shaft and a replaceable lower active portion of self-consuming material is known per se, the figures enclosed and therefore their specifications are limited to the components essential to the invention. Only in FIG. 6 for the sake of completeness is the shaft of a relevant electrode illustrated in more detail.

Figure 1:
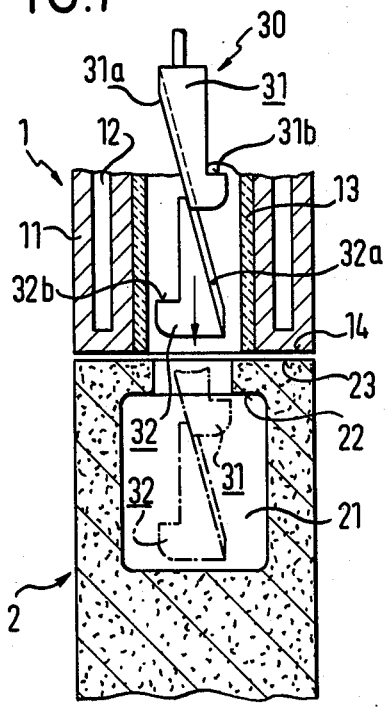
FIG. 1 is a schematic drawing of an axial section through a first embodiment of the inventive electrode where the connection process between the active portion and shaft is indicated.
Figure 2:
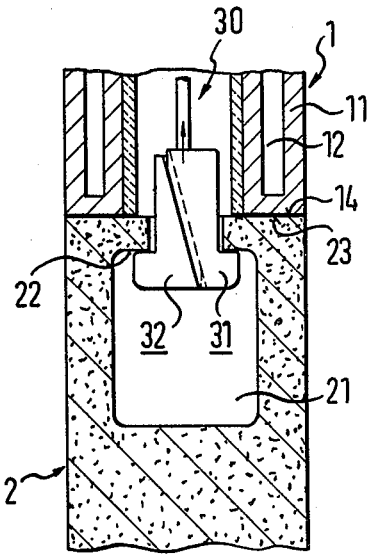
FIG. 2 shows the arrangement of FIG. 1 in operating mode.

FIGS. 1 and 2 show a first embodiment of the inventive electrode. The metallic liquid-cooled upper shaft as a whole is designated 1 and the exchangeable lower active portion of self-consuming material is marked in toto with 2. Of shaft 1 only the current-conductive component is shown in the form of a tube 11, in which the coolant channels have been marked with 12. On the inner surface of the tube 11 there is an electrical insulation 13. All the other parts of shaft 1, such as outer insulation or the like have not been shown.

The clamping device as a whole is marked 30. It comprises two jaws 31 and 32. These clamping jaws 31 and 32 are displaceable relative to each other longitudinally on their designed inclined surfaces 31*a*, 32*a*. Since the inclined surfaces 31*a*, 32*a* extend at a slight angle to the axis of the whole arrangement, when jaws 31 and 32 are moved apart, along the inclined surfaces 31*a*, 32*a*, there is a radial diminution of the arrangement, while when the jaws 31, 32 are moved together, radial enlargement results for the arrangement. In order to guide the jaws in the manner described above to interlock positively, they are interconnected positively by swallowtailed guide.

The active portion 2 has a blind bore 21 which possesses an undercut surface 22. In this blind bore 21 the two clamping jaws 31 and 32 can be introduced. For this purpose, as shown by the two positions in FIG. 1, jaws 31,32 are moved apart so that their radial extension is decreased. After the jaws 31,32 have been introduced into the blind hole 21 of the active portion 2, as shown in FIG. 2, the jaws are moved together whereby their radial extension is enlarged and the clamping surfaces 31*b*,32*b* abut the undercut clamping surface 22 of the blind hole 21 of the active part 2. In this clamping position the two jaws 31,32 are moved as a whole axially upwards, whereby the front surface 23 of the active portion 2 abuts the front surface 14 of the current supply tube 11. Thus the electrical connection between shaft 1 and active portion 2 is effected.

Figure 3:
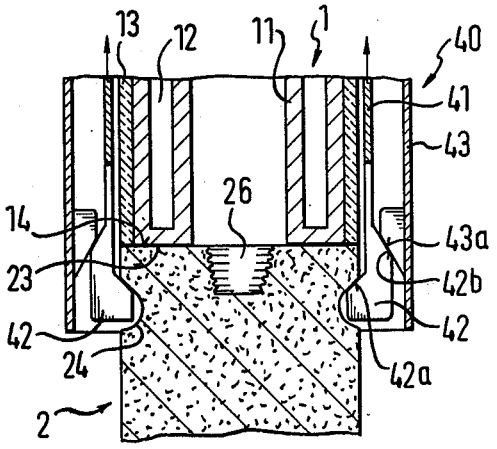
FIG. 3 shows a further embodiment of the inventive electrode schematically portrayed as to the essential components.

FIG. 3 shows a further embodiment of the inventive electrode. The clamping means designated as a whole by 40 surrounds the shaft marked as a whole as 1. Clamping means 40 comprises a collet 41. This collet 41 surrounds concentrically a current supply tube 11 of shaft 1. It has at its lower end clamping jaws 42 with clamping surfaces 42*a* formed on them. Jaws 42 of the collet 41 can be separate elements or can be made by corresponding longitudinal slits in collet 41. The only essential point is that the jaws are radially movable(42).

Collet 41 is concentrically surrounded by a tube 43, on the inside of which in the area of jaws 42, wedge surfaces 43*a* are located, which interact with wedge surfaces 42*b* of the jaws 42 in a manner to be described in more detail below. At the top end of active portion 2 a peripheral groove 24 is formed in the surface into which according to the drawing the clamping jaws 42 with its clamping surfaces 42*a* can engage. To make this possible the collet 41 and the outer tube 43 are axially movable in relation to each other. If collet 41 and tube 43 are moved apart, the clamping surfaces 42*b* and 43*a* disengage, whereby the jaws 42 can move outward radially. In this position of clamping jaws 42, the upper end of the active portion can be thrust between the jaws. When collet 41 and the tube 43 are moved together, the clamping surfaces 42*b* and 42*a* engage, whereby the clamping jaws 42 are radially moved inwards until their clamping surfaces 42*b* abut the upper wall surface of the peripheral groove 24 of the active portion 2. Then the collet 41 and tube 43 are moved jointly upwards, whereby the front contact surface 23 of active portion 2 comes into electrically conductive contact with the contact surface 14 of the current-carrying tube 11.

Figure 4:
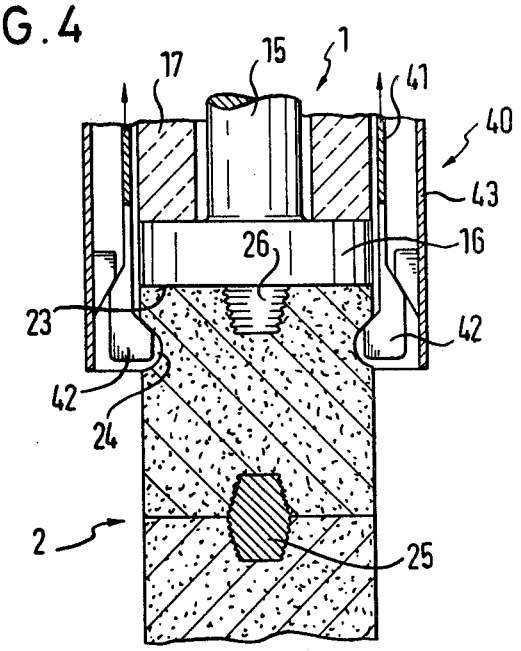
FIG. 4 is an arrangement comparable with a design as in FIG. 3, but in which the current-carrying component of the shaft has been otherwise designed.

The embodiment of FIG. 4 differs from that of FIG. 3 in that primarily the current-conducting component of shaft 1 is different from that of the previous variants. It is in fact designed as a solid bar 15 which merges at its lower end into a contact plate 16. The outer diameter of contact plate 16 corresponds approximately to the outer diameter of active portion 2. This effects not only a design of the current-conducting part of shaft 1 which is very economical in materials, but also causes a large contact surface between contact plate 16 and the relevant frontal surface 23 of the active portion 2. To protect the solid bar 15 against thermal and mechanical influences, it can be surrounded by a protective tube 17 which may be cooled and is made of a cheaper material than that of the current-conducting component 15,16.

FIG. 4 indicates that the active portion 2 can consist of several sections, of which respectively two adjacent sections are interconnected by means of a screw nipple 25.

The top section of the active portion 2, which is to be regarded as a kind of adapter and carries the peripheral groove 24, has on its upper front side a blind borehole 26, which is suitable for the insertion of a screw nipple 25. In this way this section, if it is no longer suitable as an adapter, can be connected with the active portion 2 as an expendable section and can then be consumed, whereby there is no loss of material.

FIGS. 5 to 8 show arrangements in which the respective clamping means are arranged within the current-bearing tube 11 of shaft 1.

Figure 5:
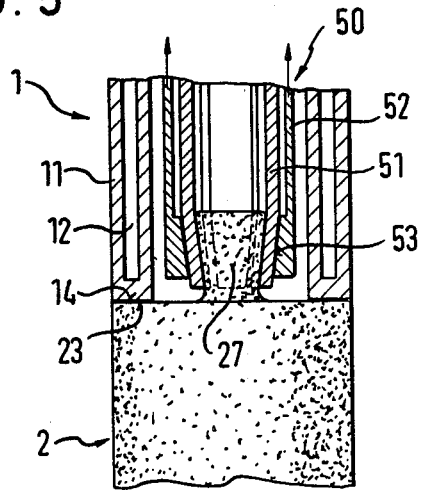
FIG. 5 shows another embodiment of the inventive electrode schematically illustrated by an axial section through the important components.

According to FIG. 5, the clamping device in the live tube 11, designated as a whole as 50, consists of a collet 51 and a pressure sleeve 52 which concentrically surrounds said collet. This sleeve 52 has a conical inner surface 53 which abuts a corresponding conical outer surface of the collet 51. Due to the corresponding relative motion between collet 51 and pressure sleeve 52, the jaws of the clamping collet are moved radially outward or inward. To interact with the clamping device, the active portion 2 has at its upper end a clamping cone 27 which expands toward its free end and which is thrust between the jaws of the collet when they are moved apart, whereupon by a corresponding relative motion between collet 51 and the pressure sleeve 52, the jaws of collet 51 are brought into the clamp position on the clamping cone 27. Then collet 51 and pressure sleeve 52 are moved upwards axially and jointly, in order to bring contact surface 23 of the active portion 2 into electrically conductive connection with the contact surface of the current bearing tube 11.

Figure 6:
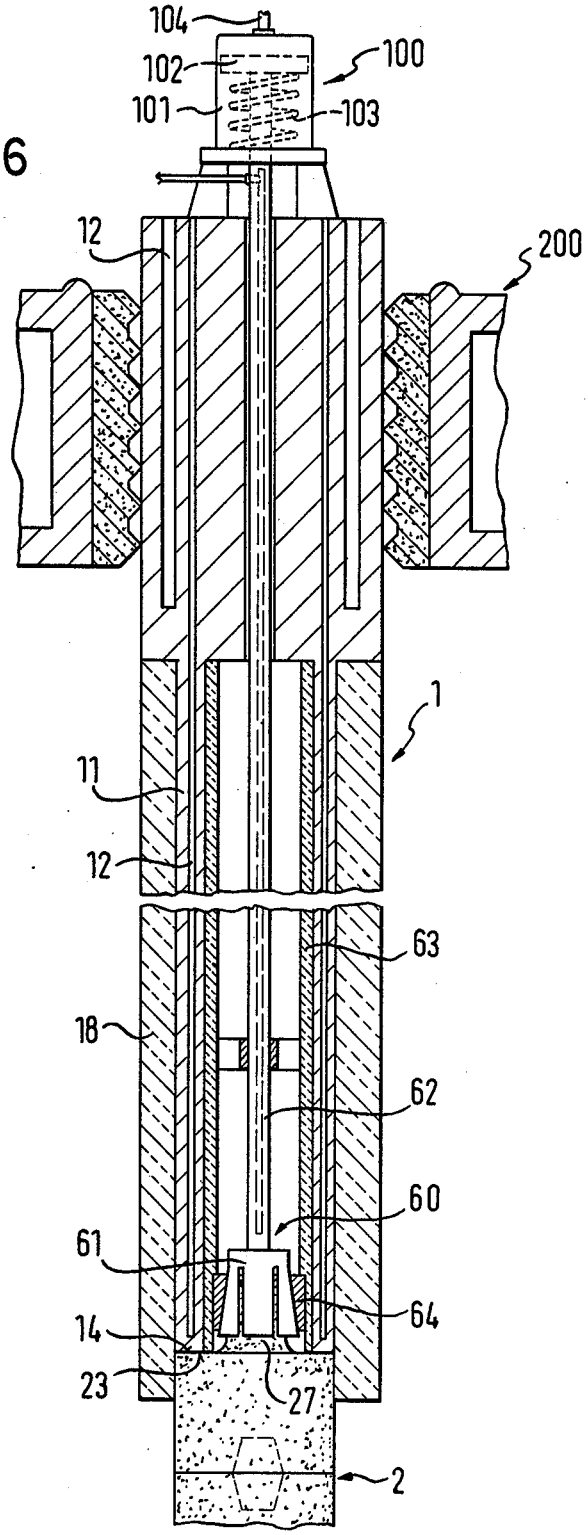
FIG. 6 is an axial section through a further variant of the inventive electrode, in which the design of the shaft is shown more precisely.

FIG. 6 concerns an arrangement in which the total clamping means designated 60 essentially corresponds to that of FIG. 5. But FIG. 6 shows in more detail the design of shaft 1 and the control of the clamping means 60. The latter comprises a collet 61, which is connected to an actuating element 62. Collet 61 and the actuating element 62 are surrounded concentrically by a pressure tube 63, on the inside of which in the area of collet 61 a conical clamping surface 64 is formed. By a corresponding relative motion between collet 61 and the conical clamping surface 64, the jaws of the collet 61 are radially moved. In the present case the pressure sleeve 63 is fixed with the conical clamping surface 64, in that the pressure sleeve 63 is fitted into the current supply tube 11 with an intermediate insulation.

The collet 61 is axially moved by the actuating element 62. On the end of the actuating element 62 opposite the collet 61 there is a mechanical-hydraulic actuating device which is marked as a whole 100. This consists of cylinder 101, in which a piston 102 is displaceably positioned. Said piston 102 is connected with the tie rod 62. Between piston 102 and a fixed stop of cylinder 101, a spring 103 is stretched so that it always strives to draw the actuating element 62 and with it, the active portion 2, upwards over the collet 61. To detach active portion 2 from clamping means 16, it is only necessary to load the top side of the piston 102 with a hydraulic or pneumatic medium supplied via pipe 104 from a source (not shown), whereby the actuating element 62 moves downwards, so that the jaws of collet 61 can move radially outwards. Thus the clamping cone 27 of the active portion 2 is released from the collet 61. In this position, the clamping cone 27 of an unexpended active portion 2 can be inserted into collet 61. Then the arrangement is again moved upwards to clamp the new active portion 2. Thus the contact surface 23 of active portion 2 also comes into electrically conductive abutment with the contact surface 14 of the current carrying tube 11.

As can also be seen from FIG. 6, the section of shaft 1 which penetrates the furnace is externally protected by a coating 18. This coating 18 consists of a suitable material which resists the prevailing thermal and mechanical stresses.

The electrode is held in a passage in the cover of the furnace by a retainer device engaging shaft 1, said device being marked as a whole 200. This retainer means 200 can be designed in any way and is therefore not described in more detail.

Figure 7:
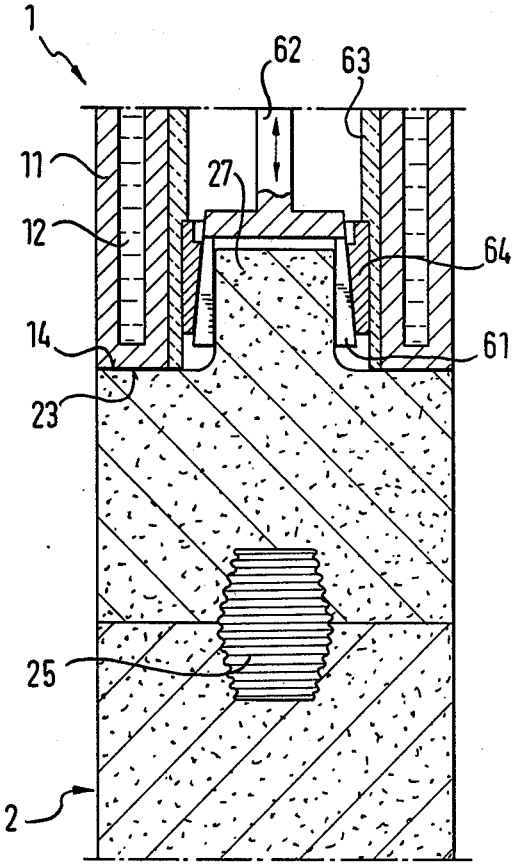
FIG. 7 is an enlarged axial section through the clamp-device of the arrangement of FIG. 6.

FIG. 7 shows the clamping means 60 of FIG. 6 in detail. From FIG. 7 it emerges that the pressure sleeve 63 can itself be made of electrically insulating material, so that the pressure sleeve 63 can directly abut the currentconductivetube 11. The conical clamping surface 64 is a separate component and is suitably connected to pressure sleeve 63.

Figure 8:
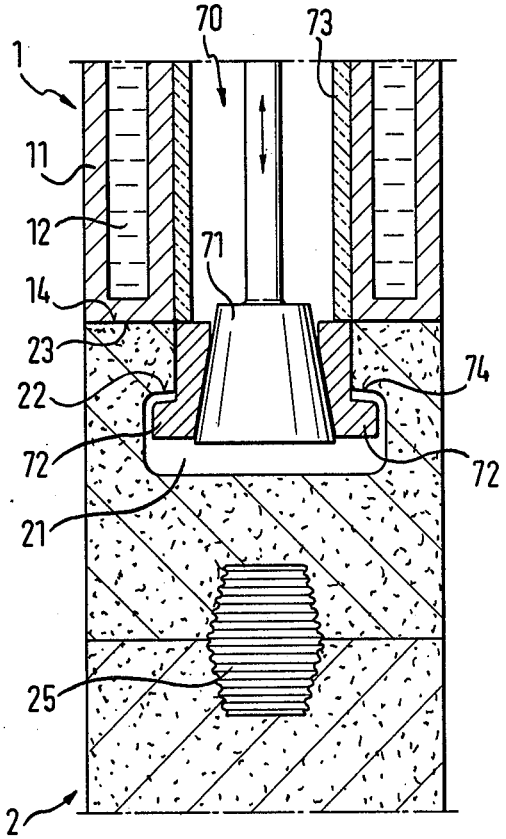
FIG. 8 is a further embodiment of the inventive electrode showing schematically an axial section through the essential components.

In the embodiment according to FIG. 8 the clamping means marked in toto with 70 is also inside the current bearing tube 11 of shaft 1, but in contrast to the previous design it engages in a suitable blind hole 21 with undercut clamping surface 22 in the active portion 2. The clamping means 70 has a mushroom-shaped actuating element 71 at its end, which is axially movable. The collet 72 is on the lower end of a fixed tube 73, which is electrically isolated from the current supply tube 11 of shaft 1 by the insertion of an insulation or by the provision of insulating materials. When actuating element 71 moves upwards, the clamping jaws of collet 72 are moved radially outwards, while on downwards motion of the actuating element 71, the jaws of collet 72 are moved radially inwards. In the position of inward radial motion of the jaws of collet 72, the clamping device 70 can be inserted in the blind hole 21 of active portion 2. Then actuating element 71 is moved upwards, so that the jaws of collet 72 move outwards, whereby the clamping surfaces 74 of collet 72 engage with the undercut clamping surface 22 of blind hole 21 of active portion 2. Then the actuating element 71 is moved upwards until contact surface 23 of active portion 2 abuts the contact surface 14 of the current supply tube 11 of shaft 1, in order to provide the electrical connection between the live component of shaft 1 and the active portion 2.

Figure 9:
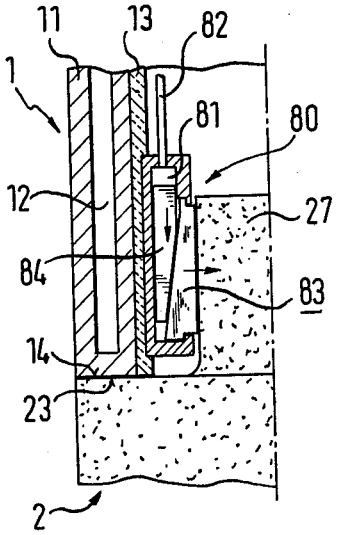
FIG. 9 is a first embodiment of an hydraulically or pneumatically actuated clamping means in axial section.

In the embodiment of FIG. 9, there is a hydraulically actuated clamping means which is marked as a whole 80. This comprises an annular space 81, which is connected via a pipe 82 with a hydraulic source not shown. The inner limits of annular chamber 81 are formed by a collet 83 consisting of separate jaws, whereby the guides for the jaws of collet 83 are leak-sealed. An axially movable wedge 84 operated by the hydraulic liquid interacts with each of the jaws of collet 83. If the wedge 84 is charged from above by the hydraulic liquid it moves downwards and vice-versa. Thus the associated jaws of collet 83 are radially moved inward or outwards.

Figure 10:
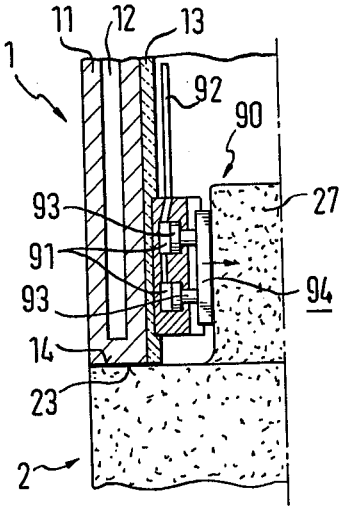
FIG. 10 is a second embodiment of an hydraulically or pneumatically actuated clamping means, also in axial section.

From FIG. 10 a further possible design emerges for an hydraulically actuated clamping means, which is marked in toto with 90. This device 90 has two annular chambers 91, which are connected via a pipe 92 to a hydraulic source not shown. In said chambers 91 radially arranged cylinder sections are provided at regular intervals, in which the pistons of plungers 93 are guided. By means of these radially movable plungers 93, the jaws of a collet 94 can be actuated to bring said jaws into clamping abutment on the clamping cone 27 of active portion 2.

Figure 11:
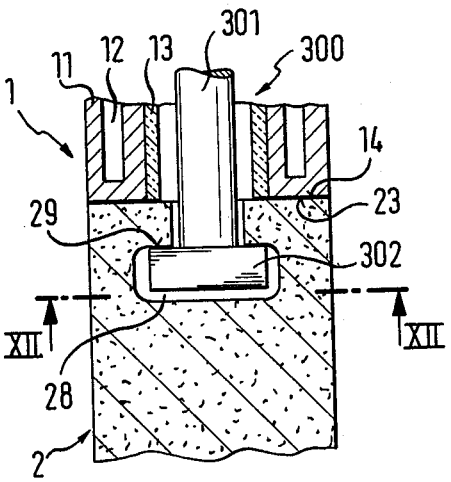
FIG. 11 is a further embodiment of the inventive electrode showing schematically an axial section through the important components.
Figure 12:
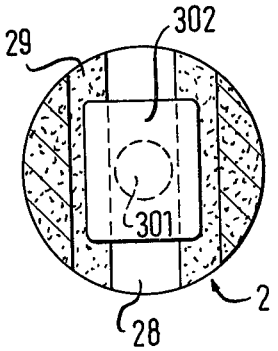
FIG. 12 is a section through the arrangement of FIG. 11, along the sectional line XII—XII.

FIGS. 11 and 12 show an embodiment in which the clamping means marked in toto with 300 is exclusively axially movable. This clamping device comprises an actuating element 301, on the lower end of which a clamp-plate 302 is affixed. At the top end of active portion 2 there is a transverse groove 28 perpendicular to the axis, which is open towards the front surface of active portion 2, and has an undercut clamping surface 29. In this transverse groove 28 the clamping plate 302 of the clamping means 300 can be inserted to lock positively perpendicular to the axis, for which purpose actuating element 301 and the clamping plate 302 are correspondingly lowered. After the coupling of active portion 2 with the clamping means 300, actuating element 301 is moved upward, until the contact surface 23 of active portion 2 comes into electrically conductive abutment with contact surface 14 of the current supply tube 11.

In the clamping means described above the main aim is to ensure that the clamping force exerted by the respective device directly on the active portion primarily pressure-loads the material of said active portion. Naturally in the usual way the active portion is tensile-loaded due to its own weight.

The power supply components of the arrangement consist of a suitable electrically conductive material, such as copper or a corresponding metal alloy. Both current-conducting and the other components of the shaft are suitably cooled and are secured by coatings against thermal and mechanical excessive stresses. The slide guides used between the various components can be coated with graphite or similar greases resistant to high temperatures or can be lined in order to provide good sliding conditions even at high temperatures and under great mechanical stresses. The coatings concerned are expediently made of ceramic materials resistant to high temperatures. The active portions primarily consist of graphite.

We claim:

1. In an electrode for arc furnaces, especially for the production of electrosteel, including an electrical current conducting metallic, liquid-cooled upper electrode shaft portion and a consumable lower active portion; the improvement comprising: a securing means detachably connecting the upper electrode shaft portion and the consumable active portion whereby an electrical contact surface of the active portion is pressed against and forcibly retained against an electrical contact surface of the upper electrode shaft portion, the securing means being a clamping means effecting both an essentially compressive pressure-load upon the material of the active portion and a drawing force upon the active electrode portion whereby the electrical contact surface of the active portion is drawn forcibly against the contact surface of the upper electrode shaft portion.

2. An electrode according to claim 1, the clamping force being created by at least one of hydraulic actuating means, pneumatic actuating means and the weight of the active portion itself.

3. An electrode according to claim 2, the clamping means having a cooling means.

4. An electrode according to claim 2, the clamping means non threadably griping an upper area of the active portion and drawing the active portion upwardly into contact with the upper electrode shaft portion.

5. An electrode according to claim 4, the clamping means comprising a plurality of clamping jaws in pairs having mating inclined surfaces, one jaw in the pair being capable of axial movement so as to impart radial motion to the pair, and the active portion including a blind aperture having an undercut surface, clamping surfaces of said clamping jaws engaging the undercut surfaces.

6. An electrode according to claim 5, the inclined surface being formed directly between two clamping jaws of a pair, the jaws being longitudinally movably slideable in relation each to the other.

7. An electrode according to claim 5 or 6, the pair of clamping jaws being positively interconnected by means of dovetailing the inclined surfaces.

8. An electrode according to claim 4, the clamping means comprising a collet having outer surfaces contacting one of the upper portion and the active portion and expandable by a pressure means.

9. An electrode according to claim 8, the clamping means comprising a collet, inner surfaces thereof contacting the active portion, the collet being constrictable into contact with the active portion utilizing a pressure means.

10. An electrode according to claim 9, the collet being a single piece having at least one longitudinal slit.

11. An electrode according to claim 9, the collet being comprised of a plurality of segments.

12. An electrode according to claim 4, the active portion including a peripheral surface, the clamping means griping the active portion upon the peripheral surface, and including a collet having externally disposed wedge surfaces and a tube surrounding the collet and having internally disposed wedge surfaces arranged for interaction with the externally disposed wedge surfaces, the collet surrounding an electrical current carrying component of the electrode.

13. An electrode according to claim 4, the clamping means being an electrical current-conducting component of a shaft of the electrode and including a collet griping the active portion at a clamping cone mounted thereon.

14. An electrode according to claim 13 including a pressure means comprising a pressure sleeve, including a conical inner surface abutting a corresponding conical outer surface of the collet.

15. An electrode according to claim 14, the pressure arrangement having a mushroom configured actuating element including a conical outer surface abutting a corresponding conical inner surface of the collet.

16. An electrode according to claim 15, one surface of the collet being cylindrically configured to lockingly engage the active portion.

17. An electrode according to claim 15, a surface of the collet being conically configured for forming a positive and a force-locking connection to the active portion.

18. An electrode according to claim 17, the surface of said collet having projections for forming a positive locking connection additional to the force-locking connection.

19. An electrode according to claim 18, the projections being radially resiliently mounted within the collet to form a snap coupling with the active portion when thrust into said collet.

20. An electrode according to claim 19, the projections being spring-loaded.

21. An electrode according to claim 13, including a pressure actuating means for the collet having axially movable, pressurized fluid actuated wedge means.

22. An electrode according to claim 13, including a pressure means for actuating the collet comprising a plurality of hydraulically or pneumatically radially movable plungers.

23. An electrode according to any one of claims 13–24, the clamping means being only axially movable.

24. An electrode according to claim 23, a connector being positively locked with an active portion.

25. An electrode according to any one of claims 4, 7, 12 and 21, the clamping means surrounding an electrical current-conducting component of a shaft of the electrode, said electrical current conducting component being configured as a solid bar terminating in a contact plate.

26. An electrode according to claim 25, the contact plate having an outer diameter approximately corresponding to an outer diameter of the active portion.

27. An electrode according to any one of claims 4, 7, 12 and 21, the electrical current-conducting component of the shaft being tubular and the clamping means being placed within said tube, an outer diameter of the tube approximately corresponding to an outer diameter of said active portion.

28. An electrode for use in electric arc furnaces comprising: a metallic upper shaft, including a liquid cooling means, a lower consumable and replaceable active part, and a connection means which detachably connects the active part to the upper shaft, the connection means comprising biasing means arranged on the top of the upper shaft, clamping means for engaging the active part, and actuating means extending along the upper shaft from the biasing means to the clamping means for engaging the active part, and actuating means extending along the upper shaft from the biasing means to the clamping means, the biasing means forcing the active part, being engaged to the clamping means, in tight contact to the upper shaft.

29. The electrode of claim 28, the clamping means being actuated by one of mechanical, hydraulic and pneumatic means.

30. The electrode of claim 29, the clamping device having a separate cooling means from the cooling means of the shaft.

31. The electrode of claim 29, the clamping means comprising at least two wedge-like clamping jaws having abutments, the clamping jaws being radially and axially movable simultaneously, the active part comprising a pocket-hole having an undercut clamping surface the abutments of the clamping jaws being engagable therewith.

32. The electrode of claim 31, the wedge-like clamping jaws being positively locked to each other by means of a dovetailed joint.

33. The electrode according to claim 28, the clamping means comprising a collet at least partially arranged within the active part, the diameter of the collet being expandable by the actuating means.

34. The electrode of claim 28, the clamping means comprising a collet, the diameter of which is constrictable by the actuating means.

35. The electrode of either of claims 33 and 34, the collet comprising a single piece having at least one longitudinal slot.

36. The electrode of either of claims 33 and 34, the collet comprising a plurality of pieces.

37. The electrode of claim 34, the clamping means engaging the active part at its peripheral surface, the collet surrounding the upper shaft, the upper shaft being surrounded by a tube comprising wedged surfaces on its inner surface, the outer surface of the collet including cooperating wedged surfaces.

38. The electrode of claim 34, the clamping means being arranged within the upper shaft, the active part including a recessed portion and the collet engaging the recessed portion of the active part.

39. The electrode of claim 34, the clamping means comprising a pressure sleeve, having an inner conical surface abutting an outer conical surface of the collet.

40. The electrode of claim 34, the clamping means comprising axially movable wedges.

41. The electrode of claim 34, the clamping means comprising one of hydraulically and pneumatically radially movable rods.

42. The electrode of claim 28, clamping means being movable in an axial direction only.

43. The electrode of claim 37, the upper shaft being a solid bar having a contact plate at its lower end.

44. The electrode of claim 43, an external diameter of the contact plate corresponding approximately to an outer diameter of the active part.

45. The electrode of one of the claims 28, 29, 31, 32, 39, 40 and 42, the upper shaft being a tube, the actuating means being arranged within this tube, the external diameter of the tube corresponding substantially to the outer diameter of the active part.

* * * * *